US011393375B2

(12) United States Patent
Wang et al.

(10) Patent No.: US 11,393,375 B2
(45) Date of Patent: Jul. 19, 2022

(54) SOURCE DRIVER AND POLARITY INVERSION CONTROL CIRCUIT

(71) Applicant: HIMAX TECHNOLOGIES LIMITED, Tainan (TW)

(72) Inventors: Siangwei Wang, Tainan (TW); Hung-Yu Huang, Tainan (TW)

(73) Assignee: HIMAX TECHNOLOGIES LIMITED, Tainan (TW)

( * ) Notice: Subject to any disclaimer, the term of this patent is extended or adjusted under 35 U.S.C. 154(b) by 0 days.

(21) Appl. No.: 17/037,726

(22) Filed: Sep. 30, 2020

(65) Prior Publication Data

US 2022/0101768 A1 Mar. 31, 2022

(51) Int. Cl.
*G09G 3/36* (2006.01)
*G09G 3/20* (2006.01)

(52) U.S. Cl.
CPC ..... *G09G 3/20* (2013.01); *G09G 2310/0254* (2013.01); *G09G 2310/0275* (2013.01); *G09G 2310/0289* (2013.01); *G09G 2310/0291* (2013.01); *G09G 2310/08* (2013.01)

(58) Field of Classification Search
None
See application file for complete search history.

(56) References Cited

U.S. PATENT DOCUMENTS

2011/0102471 A1* 5/2011 Hsu ..... G09G 3/3614 345/690
2020/0027412 A1 1/2020 Huang et al.
2021/0398477 A1* 12/2021 Kuo ..... G09G 3/3614

FOREIGN PATENT DOCUMENTS

TW 201506891 2/2015
TW 201802792 1/2018

OTHER PUBLICATIONS

"Office Action of Taiwan Counterpart Application", dated Aug. 13, 2021, p. 1-p. 6.

* cited by examiner

*Primary Examiner* — Amr A Awad
*Assistant Examiner* — Donna V Bocar
(74) *Attorney, Agent, or Firm* — JCIPRNET

(57) ABSTRACT

A source driver and a polarity inversion control circuit are provided. The source driver includes a plurality of channel pairs and the polarity inversion control circuit. The polarity inversion control circuit includes a signal generating circuit and a routing circuit. The signal generating circuit generates a polarity control signal. The routing circuit outputs a plurality of switching control signals corresponding to the polarity control signal to a plurality of output switching circuits of the channel pairs. The routing circuit changes the correspondence between the polarity control signal and the switching control signals according to a polarity inversion configuration signal.

17 Claims, 6 Drawing Sheets

212

SOURCE DRIVER AND POLARITY INVERSION CONTROL CIRCUIT

BACKGROUND

Technical Field

The invention relates to an electronic circuit, and particularly relates to a source driver and a polarity inversion control circuit.

Description of Related Art

In a display device, a source driver may drive a display panel to display an image according to control of a timing controller. In order to prevent characteristics of liquid crystal molecules from being destroyed, the timing controller may control the source driver to perform polarity inversion. In general, the source driver includes a plurality of channel pairs for driving the display panel. Each of the channel pairs includes a positive polarity channel, a negative polarity channel, and an output switching circuit. The positive polarity channel is configured to provide a positive polarity driving voltage higher than a common voltage. The negative polarity channel is configured to provide a negative polarity driving voltage lower than the common voltage.

FIG. 1 is a circuit block schematic diagram of a conventional source driver 20. The source driver 20 shown in FIG. 1 may drive a display panel 10 to display images according to control of a timing controller (not shown). The source driver 20 includes a plurality of channel pairs P_1, P_2, . . . , P_m, where m is an integer. The channel pair P_1 includes a positive polarity channel CH_1, a negative polarity channel CH_2, a signal generating circuit P1 and an output switching circuit OSW1. A first input terminal and a second input terminal of the output switching circuit OSW1 are respectively coupled to an output terminal of the positive polarity channel CH_1 and an output terminal of the negative polarity channel CH_2. The channel pair P_2 includes a positive polarity channel CH_3, a negative polarity channel CH_4, a signal generating circuit P2 and an output switching circuit OSW2. A first input terminal and a second input terminal of the output switching circuit OSW2 are respectively coupled to an output terminal of the positive polarity channel CH_3 and an output terminal of the negative polarity channel CH_4. Deduced by analogy, the channel pair P_m includes a positive polarity channel CH_n−1, a negative polarity channel CH_n, a signal generating circuit Pm and an output switching circuit OSWm. A first input terminal and a second input terminal of the output switching circuit OSWm are respectively coupled to an output terminal of the positive polarity channel CH_n−1 and an output terminal of the negative polarity channel CH_n.

First output terminals and second output terminals of the output switching circuits OSW1-OSWm are coupled to data lines D1, D2, D3, D4, . . . , Dn−1 and Dn of the display panel 10, as shown in FIG. 1. Each of the positive polarity channels (such as CH_1, CH_3, and CH_n−1) has a latch LCH, a level shifter LS, a digital to analog converter DAC, and a positive polarity amplifier OP+. The positive polarity amplifier OP+ is used to provide a positive polarity driving voltage. Each of the negative polarity channels (for example, CH_2, CH_4, and CH_n) has a latch LCH, a level shifter LS, a digital to analog converter DAC, and a negative polarity amplifier OP−. The negative polarity amplifier OP− is used to provide a negative polarity driving voltage.

The timing controller (not shown) may output a polarity signal POL to the source driver 20 to control a polarity inversion operation of the source driver 20. For example, when the polarity signal POL is in a logic state "0", a polarity configuration of the data lines D1-Dn is "+ − + − + − + − + − . . . ", where "+" represents the positive polarity driving voltage, and "−" represents the negative polarity driving voltage. When the polarity signal POL is in a logic state "1", the polarity configuration of the data lines D1-Dn is "− + − + − + − + . . . ". However, according to a characteristic, a design requirement, and/or other considerations of the display panel 10, polarity configurations (polar relationship) of the data lines D1-Dn in other application situations may be different from the polarity configuration (polar relationship) of the data lines D1-Dn in the aforementioned application situation. For example, in another application situation, when the polarity signal POL is in the logic state "0", the polarity configuration of the data lines D1-Dn needs to be set to "+ − − + − + + − . . . " (or, when the polarity signal POL is in the logic state "1", the polarity configuration of the data lines D1-Dn is "− + + − + − − + . . . ").

Namely, in different application situations, the polarity configuration (polar relationship) of the data lines D1-Dn may be different. Therefore, the customized signal generating circuits P1-Pm are arranged in the channel pairs P_1-P_m of the conventional source driver 20. The signal generating circuits P1-Pm may generate different switching control signals S1, S2, . . . , Sm to the output switching circuits OSW1-OSWm according to the polarity signal POL. In this way, the output switching circuits OSW1-OSWm may output driving voltages conforming to a customized polarity configuration (polarity relationship) to the data lines D1-Dn of the display panel 10.

Generally, the polarity signal POL and logic circuits of the signal generating circuits P1-Pm are operated in a low voltage range, and the switching control signals S1-Sm need to be operated in a high voltage range. Therefore, a level shifter needs to be arranged in each of the signal generating circuits P1-Pm. When the number m of the channel pairs P_1-P_m becomes larger, the number of the signal generating circuits P1-Pm becomes greater. A large amount of the signal generating circuits P1-Pm (the level shifters) may occupy a limited chip area of the source driver 20.

The information disclosed in this Background section is only for enhancement of understanding of the background of the described technology and therefore it may contain information that does not form the prior art that is already known to a person of ordinary skill in the art. Further, the information disclosed in the Background section does not mean that one or more problems to be resolved by one or more embodiments of the invention was acknowledged by a person of ordinary skill in the art.

SUMMARY

The invention is directed to a source driver and a polarity inversion control circuit, adapted to reduce a circuit area as much as possible.

An embodiment of the invention provides a source driver including a plurality of channel pairs and a polarity inversion control circuit. The channel pairs are adapted to drive a display panel. Each of the channel pairs includes a positive polarity channel, a negative polarity channel, and an output switching circuit. A first input terminal and a second input terminal of the output switching circuit are respectively coupled to an output terminal of the positive polarity channel and an output terminal of the negative polarity channel. A first output terminal and a second output terminal of the output switching circuit are coupled to the display panel. The polarity inversion control circuit includes a signal generating circuit and a routing circuit. The signal generating circuit is configured to generate a polarity control signal. The routing circuit is coupled to the signal generating circuit to receive the polarity control signal. The routing circuit is configured to output a plurality of switching control signals corresponding to the polarity control signal to the output switching circuits. The routing circuit changes a correspondence between the polarity control signal and the switching control signals according to a polarity inversion configuration signal.

An embodiment of the invention provides a polarity inversion control circuit includes a signal generating circuit and a routing circuit. The signal generating circuit is configured to generate a polarity control signal. The routing circuit is coupled to the signal generating circuit to receive the polarity control signal. The routing circuit is configured to output a plurality of switching control signals corresponding to the polarity control signal to a plurality of output switching circuits of a plurality of channel pairs of a source driver. The routing circuit changes a correspondence between the polarity control signal and the switching control signals according to a polarity inversion configuration signal.

Based on the above description, the multiple channel pairs in the embodiments of the invention are capable of sharing the same signal generating circuit. Therefore, a circuit area of the source driver may be reduced as much as possible.

To make the aforementioned more comprehensible, several embodiments accompanied with drawings are described in detail as follows.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
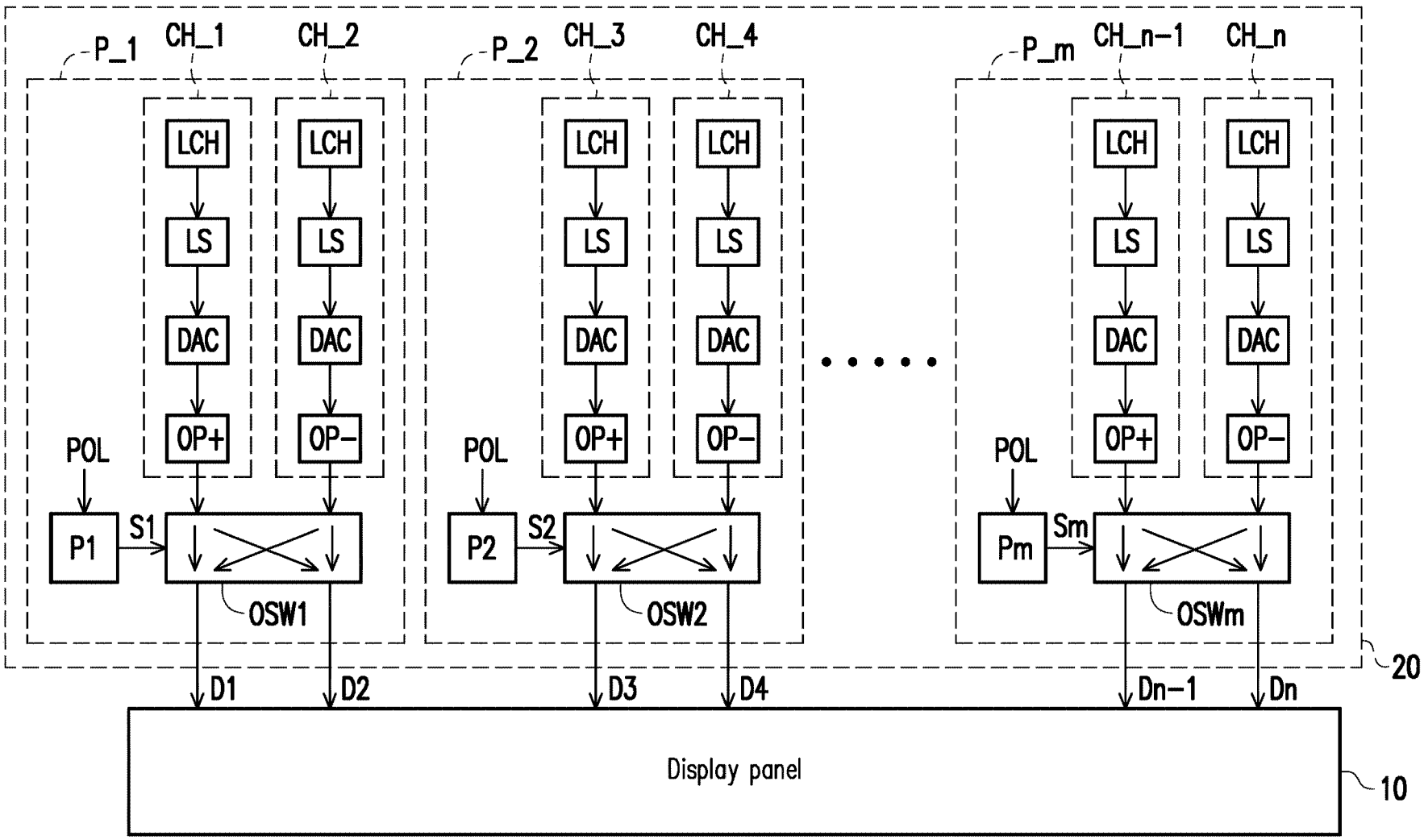
FIG. 1 (PRIOR ART)
FIG. 1 is a circuit block schematic diagram of a conventional source driver.

A term "couple (or connect)" used in the full text of the disclosure (including the claims) refers to any direct and indirect connections. For example, if a first device is described to be coupled to a second device, it is interpreted as that the first device is directly coupled to the second device, or the first device is indirectly coupled to the second device through other devices or connection means. "First", "second", etc. mentioned in the specification and the claims are merely used to name discrete components and should not be regarded as limiting the upper or lower bound of the number of the components, nor is it used to define an order of the components. Moreover, wherever possible, components/members/steps using the same referential numbers in the drawings and description refer to the same or like parts. Components/members/steps using the same referential numbers or using the same terms in different embodiments may cross-refer related descriptions.

Figure 2:
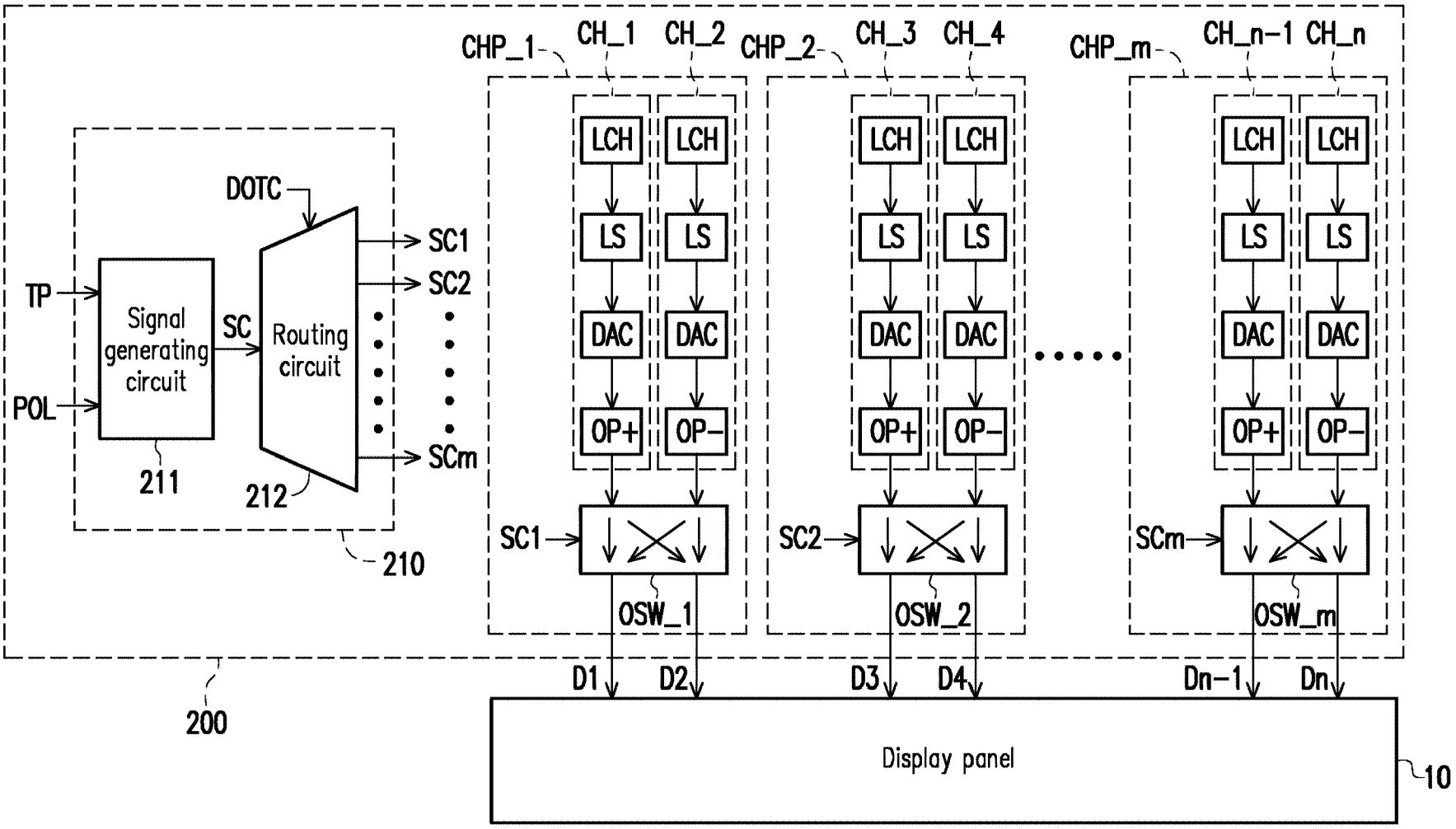
FIG. 2 is a circuit block schematic diagram of a source driver according to an embodiment of the invention.

FIG. 2 is a circuit block schematic diagram of a source driver 200 according to an embodiment of the invention. The source driver 200 shown in FIG. 2 may drive the display panel 10 to display images according to control of a timing controller (not shown). The source driver 200 includes a plurality of channel pairs CHP_1, CHP_2, . . . , CHP_m, where m is an integer. The channel pair CHP_1 includes a positive polarity channel CH_1, a negative polarity channel CH_2, and an output switching circuit OSW_1. A first input terminal and a second input terminal of the output switching circuit OSW_1 are respectively coupled to an output terminal of the positive polarity channel CH_1 and an output terminal of the negative polarity channel CH_2. The channel pair CHP_2 includes a positive polarity channel CH_3, a negative polarity channel CH_4, and an output switching circuit OSW_2. A first input terminal and a second input terminal of the output switching circuit OSW_2 are respectively coupled to an output terminal of the positive polarity channel CH_3 and an output terminal of the negative polarity channel CH_4. Deduced by analogy, the channel pair CHP_m includes a positive polarity channel CH_n−1, a negative polarity channel CH_n, and an output switching circuit OSW_m, where n is an integer. A first input terminal and a second input terminal of the output switching circuit OSW_m are respectively coupled to an output terminal of the positive polarity channel CH_n−1 and an output terminal of the negative polarity channel CH_n. Related description of the polarity channels CH_1-CH_n shown in FIG. 1 may be referred for description of the polarity channels CH_1-CH_n shown in FIG. 2, and detail thereof is not repeated.

First output terminals and second output terminals of the output switching circuits OSW_1-OSW_m are coupled to data lines D1, D2, D3, D4, . . . , Dn−1 and Dn of the display panel 10, as show in FIG. 2. A polarity inversion control circuit 210 may receive a line latch signal TP and a polarity signal POL provided by a timing controller (not shown). The line latch signal TP may be a start pulse of a line. According to the line latch signal TP and the polarity signal POL, the polarity inversion control circuit 210 may output a plurality of switching control signals SC1, SC2, . . . , SCm to the output switching circuits OSW_1-OSW_m.

According to a characteristic, a design requirement, and (or) other considerations of the display panel 10, polarity configurations (polar relationship) of the data lines D1-Dn may be different in different application situations. For example, in a certain application situation, when the polarity signal POL is in a logic state "0", the polarity configuration of the data lines D1-Dn needs to be set to "+ − + − + − + − . . . ", where "+" represents a positive polarity driving voltage, and "−" represents a negative polarity driving voltage. In another application situation, when the polarity signal POL is also in the logic state "0", the polarity configuration of the data lines D1-Dn needs to be set to "+ − − + − + + − . . . ".

The polarity inversion control circuit 210 may generate different switching control signals SC1-SCm to the output switching circuits OSW_1-OSW_m according to the line latch signal TP and the polarity signal POL. The polarity inversion control circuit 210 may change a logic configuration of the switching control signals SC1-SCm according to a polarity inversion configuration signal DOTC, so as to control/change the polarity configuration (polarity relationship) of the data lines D1-Dn. For example, in case that the polarity inversion configuration signal DOTC is in the logic state "0" (in a certain application situation), when the polarity signal POL is in the logic state "0", the polarity inversion control circuit 210 may change the logic configuration of the switching control signals SC1-SCm to set the polarity configuration of the data lines D1-Dn to "+ − + − + − + − . . . ". In case that the polarity inversion configuration signal DOTC is in the logic state "1" (in another application situation), when the polarity signal POL is also in the logic state "0", the polarity inversion control circuit 210 may change the logic configuration of the switching control signals SC1-SCm to set the polarity configuration of the data lines D1-Dn to "+ − − + − ++ − . . . ".

The channel pairs CHP_1 to CHP_m may share the same polarity inversion control circuit 210, and the polarity inversion control circuit 210 may change the logic configuration of the switching control signals SC1-SCm according to different application situations. Based on the control of the switching control signals SC1-SCm, the output switching circuits OSW_1-OSW_m may output driving voltages conforming to a customized polarity configuration (polarity relationship) to the data lines D1-Dn of the display panel 10.

In the embodiment of FIG. 2, the polarity inversion control circuit 210 includes a signal generating circuit 211 and a routing circuit 212. The signal generating circuit 211 may receive the line latch signal TP and the polarity signal POL provided by the timing controller (not shown). According to the line latch signal TP and the polarity signal POL, the signal generating circuit 211 may generate a polarity control signal SC to the routing circuit 212. The signal generating circuit 211 may be implemented according to a design requirement. For example, in some embodiments, when the line latch signal TP is in the logic state "1", regardless of the logic state of the polarity signal POL, the polarity control signal SC is in the logic state "1". When the line latch signal TP and the polarity signal POL are in the logic state "0", the polarity control signal SC is in the logic state "0". When the line latch signal TP is in the logic state "0" and the polarity signal POL is in the logic state "1", the polarity control signal SC is in the logic state "1".

The routing circuit 212 is controlled by the polarity inversion configuration signal DOTC. The routing circuit 212 is coupled to the signal generating circuit 211 to receive the polarity control signal SC. The routing circuit 212 may output a plurality of switching control signals SC1-SCm corresponding to the polarity control signal SC to the output switching circuits OSW_1-OSW_m of the channel pairs CHP_1-CHP_m. The routing circuit 212 may change the correspondence between the polarity control signal SC and the switching control signals SC1-SCm according to the polarity inversion configuration signal DOTC.

For example, in case that the polarity inversion configuration signal DOTC is in a logic state "00" (in a certain application situation), when the polarity control signal SC is in the logic state "0", the routing circuit 212 may change the logic configuration of the switching control signals SC1-SCm to set the polarity configuration of the data lines D1-Dn to "+ − + − + − + − . . . ". In case that the polarity inversion configuration signal DOTC is in a logic state "01" (in another application situation), when the polarity control signal SC is also in the logic state "0", the routing circuit 212 may change the logic configuration of the switching control signals SC1-SCm to set the polarity configuration of the data lines D1-Dn to "+ − − + − ++ − . . . ". In case that the polarity inversion configuration signal DOTC is in a logic state "10" (in still another application situation), when the polarity control signal SC is also in the logic state "0", the routing circuit 212 may change the logic configuration of the switching control signals SC1-SCm to set the polarity configuration of the data lines D1-Dn to "+ − − + − + − + . . . ".

Figure 3:
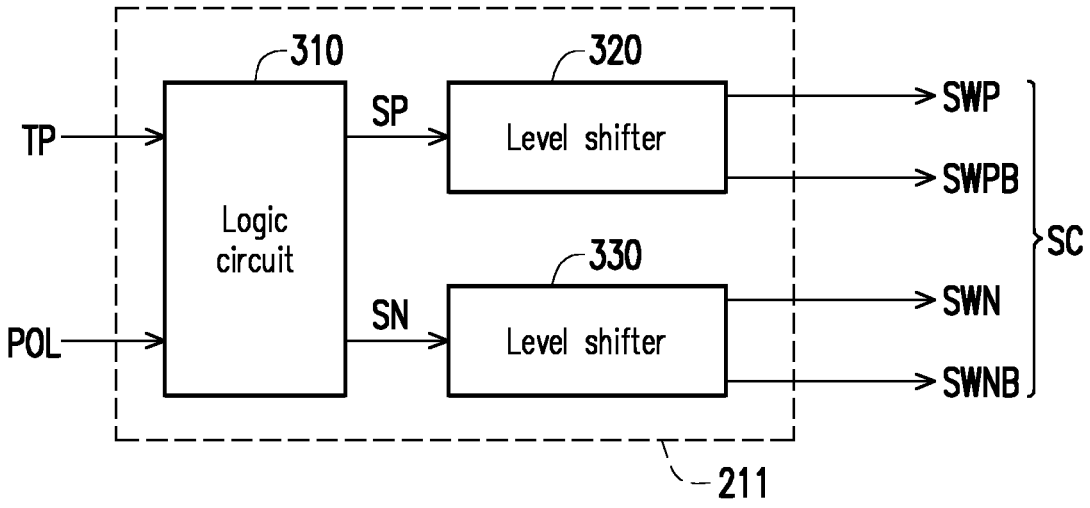
FIG. 3 is a circuit block schematic diagram of a signal generating circuit of FIG. 2 according to an embodiment of the invention.

FIG. 3 is a circuit block schematic diagram of the signal generating circuit 211 of FIG. 2 according to an embodiment of the invention. In the embodiment shown in FIG. 3, the polarity control signal SC includes original switching signals SWP, SWPB, SWN and SWNB. Where, the original switching signal SWPB is an inverted signal of the original switching signal SWP, and the original switching signal SWNB is an inverted signal of the original switching signal SWN. In any case, the polarity control signal SC in other embodiments should not be limited to the polarity control signal SC shown in FIG. 3.

The signal generating circuit 211 shown in FIG. 3 includes a logic circuit 310, a level shifter 320, and a level shifter 330. The logic circuit 310 may generate a logic signal SP and a logic signal SN according to the line latch signal TP and the polarity signal POL. The logic circuit 310 may be implemented according to a design requirement. For example, in some embodiments, when the line latch signal TP is in the logic state "1", regardless of the logic state of the polarity signal POL, the logic signal SP is in the logic state "1" (for example, a high voltage level) and the logic signal SN is in the logic state "0" (for example, a low voltage level). When the line latch signal TP and the polarity signal POL are both in the logic state "0", the logic signal SP and the logic signal SN are both in the logic state "0". When the line latch signal TP is in the logic state "0" and the polarity signal POL is in the logic state "1", the logic signal SP and the logic signal SN are both in the logic state "1".

The level shifter 320 is coupled to the logic circuit 310 to receive the logic signal SP. The level shifter 320 may generate the original switching signal SWP and the original switching signal SWPB. The level shifter 330 is coupled to the logic circuit 310 to receive the logic signal SN. The level shifter 330 may generate the original switching signal SWN and the original switching signal SWNB.

Figure 4:
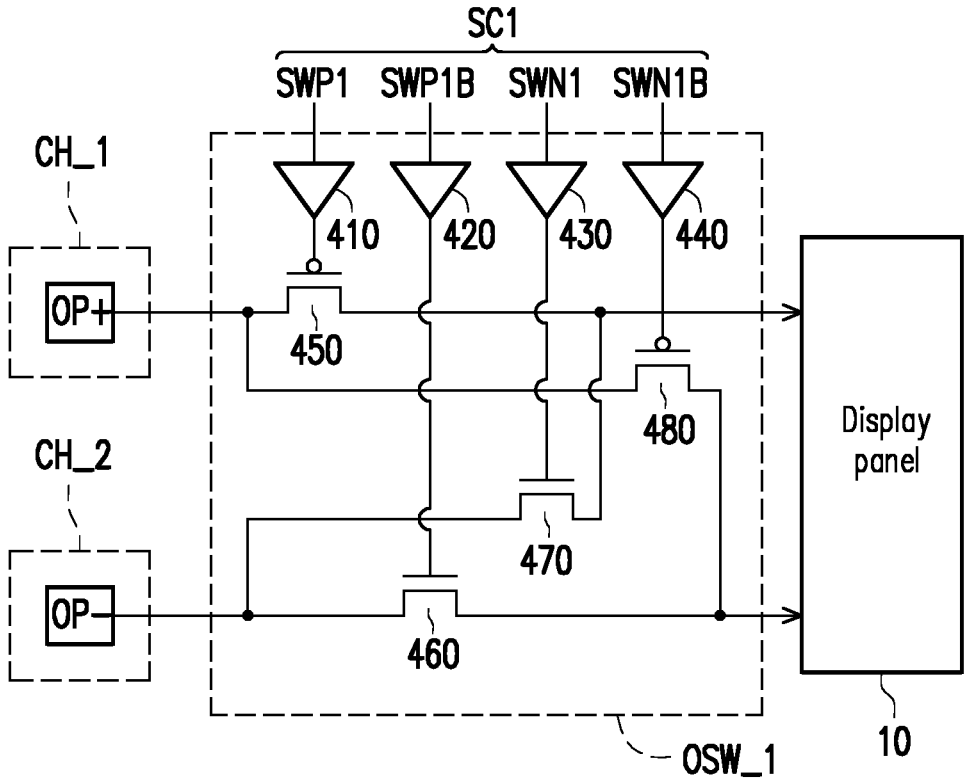
FIG. 4 is a circuit block schematic diagram of an output switching circuit of FIG. 2 according to an embodiment of the invention.

FIG. 4 is a circuit block schematic diagram of the output switching circuit OSW_1 of FIG. 2 according to an embodiment of the invention. The other output switching circuits OSW_2-OSW_m and the switching control signals SC2-SCm shown in FIG. 2 may be deduced by referring to related descriptions of the output switching circuit OSW_1 and the switching control signal SC1 shown in FIG. 4, and details thereof are not repeated. In the embodiment of FIG. 4, the switching control signal SC1 includes a switching signal SWP1, a switching signal SWP1B, a switching signal SWN1 and a switching signal SWN1B. The switching signal SWP1B is an inverted signal of the switching signal SWP1. The switching signal SWN1B is an inverted signal of the switching signal SWN1.

Referring to FIG. 2 and FIG. 4, the output switching circuit OSW_1 of the channel pair CHP_1 shown in FIG. 4 includes a buffer 410, a buffer 420, a buffer 430, a buffer 440, a switch 450, a switch 460, a switch 470, and a switch 480. An input terminal of the buffer 410 is coupled to the routing circuit 212 to receive the switching signal SWP1. An input terminal of the buffer 420 is coupled to the routing circuit 212 to receive the switching signal SWP1B. An input terminal of the buffer 430 is coupled to the routing circuit 212 to receive the switching signal SWN1. An input terminal of the buffer 440 is coupled to the routing circuit 212 to receive the switching signal SWN1B.

In the embodiment of FIG. 4, the switch 450 and the switch 480 may be p-channel metal oxide semiconductor (PMOS) transistors, and the switch 460 and the switch 470 may be n-channel metal oxide semiconductor (NMOS) transistors. However, in other embodiments, implementations of the switch 450, the switch 460, the switch 470, and the switch 480 are not limited to the implementations shown in FIG. 4.

A control terminal of the switch 450 is coupled to an output terminal of the buffer 410. A first terminal of the switch 450 is coupled to the first input terminal of the output switching circuit OSW_1, i.e., coupled to a positive polarity amplifier OP+ of the positive polarity channel CH_1. A second terminal of the switch 450 is coupled to the first output terminal of the output switching circuit OSW_1, i.e., coupled to the display panel 10. A control terminal of the switch 460 is coupled to an output terminal of the buffer 420. A first terminal of the switch 460 is coupled to the second input terminal of the output switching circuit OSW_1, i.e., coupled to a negative polarity amplifier OP− of the negative polarity channel CH_2. A second terminal of the switch 460 is coupled to the second output terminal of the output switching circuit OSW_1, i.e., coupled to the display panel 10. A control terminal of the switch 470 is coupled to an output terminal of the buffer 430. A first terminal of the switch 470 is coupled to the second input terminal of the output switching circuit OSW_1. A second terminal of the switch 470 is coupled to the first output terminal of the output switching circuit OSW_1. A control terminal of the switch 480 is coupled to an output terminal of the buffer 440. A first terminal of the switch 480 is coupled to the first input terminal of the output switching circuit OSW_1. A second terminal of the switch 480 is coupled to the second output terminal of the output switching circuit OSW_1.

Figure 5:
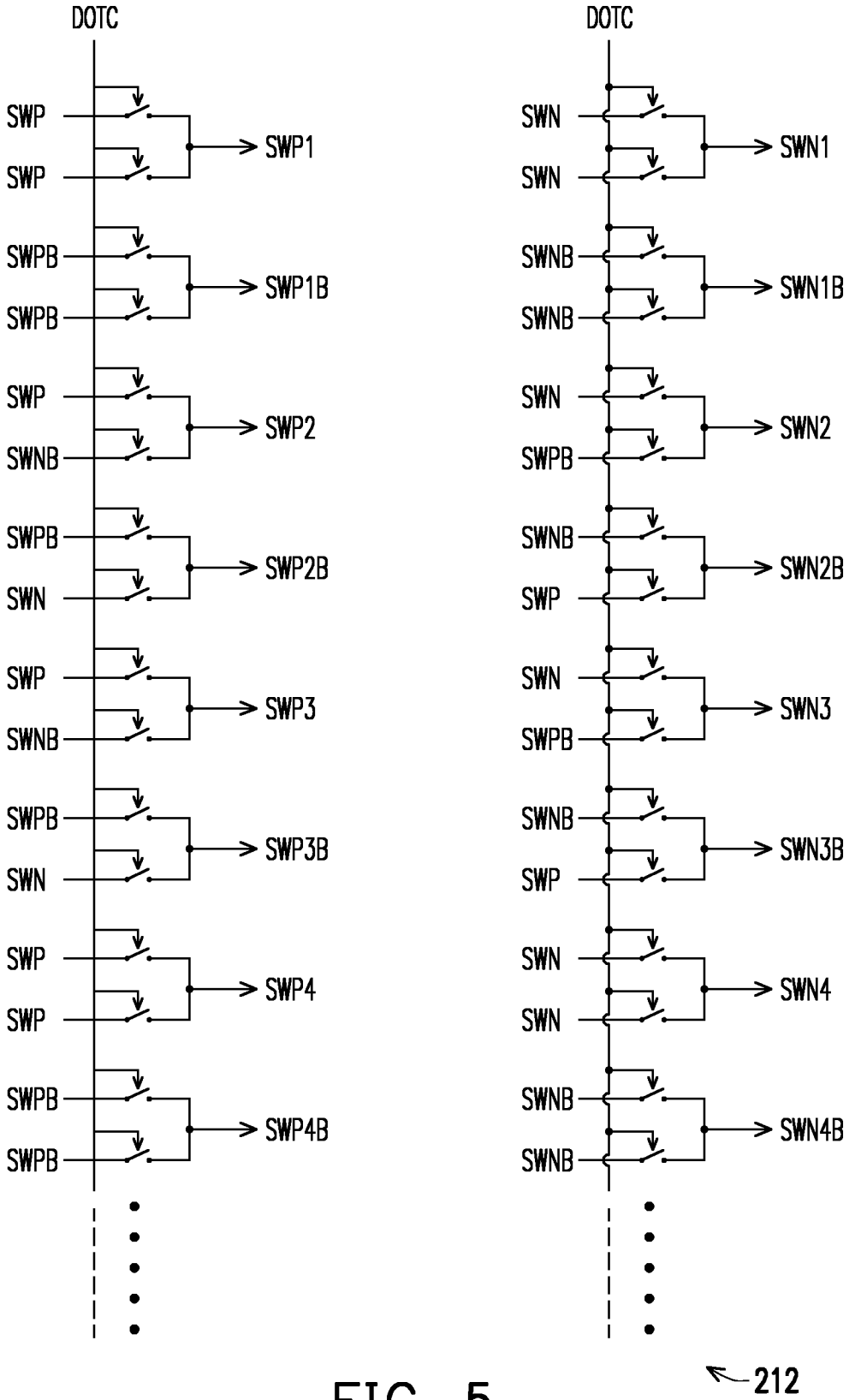
FIG. 5 is a circuit block schematic diagram of a routing circuit of FIG. 2 according to an embodiment of the invention.

FIG. 5 is a circuit block schematic diagram of the routing circuit 212 of FIG. 2 according to an embodiment of the invention. The routing circuit 212 shown in FIG. 5 includes a plurality of switches, where the switches are controlled by the polarity inversion configuration signal DOTC. Referring to FIG. 2, FIG. 3, FIG. 4 and FIG. 5, the polarity control signal SC includes the original switching signals SWP, SWPB, SWN and SWNB. The switching control signal SC1 includes the switching signal SWP1, the switching signal SWP1B, the switching signal SWN1 and the switching signal SWN1B.

The routing circuit 212 may select to output the original switching signal SWP as the switching signal SWP1 to the output switching circuit OSW_1. The routing circuit 212 may select to output the original switching signal SWPB as the switching signal SWP1B to the output switching circuit OSW_1. The routing circuit 212 may select to output the original switching signal SWN as the switching signal SWN1 to the output switching circuit OSW_1. The routing circuit 212 may select to output the original switching signal SWNB as the switching signal SWN1B to the output switching circuit OSW_1.

Deduced from the related description of the switching control signal SC1, the switching control signal SC2 may include a switching signal SWP2, a switching signal SWP2B, a switching signal SWN2 and a switching signal SWN2B. The routing circuit 212 may select to output one of the original switching signal SWP and the original switching signal SWNB as the switching signal SWP2 to the output switching circuit OSW_2 according to the polarity inversion configuration signal DOTC. The routing circuit 212 may select to output one of the original switching signal SWPB and the original switching signal SWN as the switching signal SWP2B to the output switching circuit OSW_2 according to the polarity inversion configuration signal DOTC. The routing circuit 212 may select to output one of the original switching signal SWN and the original switching signal SWPB as the switching signal SWN2 to the output switching circuit OSW_2 according to the polarity inversion configuration signal DOTC. The routing circuit 212 may select to output one of the original switching signal SWNB and the original switching signal SWP as the switching signal SWN2B to the output switching circuit OSW_2 according to the polarity inversion configuration signal DOTC.

For example, when the polarity inversion configuration signal DOTC is in a first logic state, the routing circuit 212 may select the original switching signal SWP as the switching signal SWP2, the routing circuit 212 may select the original switching signal SWPB as the switching signal SWP2B, the routing circuit 212 may select the original switching signal SWN as the switching signal SWN2, and the routing circuit 212 may select the original switching signal SWNB as the switching signal SWN2B. When the polarity inversion configuration signal DOTC is in a second logic state (different to the first logic state), the routing circuit 212 may select the original switching signal SWNB as the switching signal SWP2, the routing circuit 212 may select the original switching signal SWN as the switching signal SWP2B, the routing circuit 212 may select the original switching signal SWPB as the switching signal SWN2, and the routing circuit 212 may select the original switching signal SWP as the switching signal SWN2B.

Deduced from related descriptions of the switching control signal SC1, the switching control signal SC3 (not shown) may include a switching signal SWP2, a switching signal SWP3B, a switching signal SWN3 and a switching signal SWN3B. The routing circuit 212 may select one of the original switching signal SWP and the original switching signal SWNB as the switching signal SWP3 according to the polarity inversion configuration signal DOTC. The routing circuit 212 may select one of the original switching signal SWPB and the original switching signal SWN as the switching signal SWP3B according to the polarity inversion configuration signal DOTC. The routing circuit 212 may select one of the original switching signal SWN and the original switching signal SWPB as the switching signal SWN3 according to the polarity inversion configuration signal DOTC. The routing circuit 212 may select one of the original switching signal SWNB and the original switching signal SWP as the switching signal SWN3B according to the polarity inversion configuration signal DOTC.

Deduced from related descriptions of the switching control signal SC1, the switching control signal SC4 (not shown) may include a switching signal SWP4, a switching signal SWP4B, a switching signal SWN4 and a switching signal SWN4B. The routing circuit 212 may select the original switching signal SWP as the switching signal SWP4. The routing circuit 212 may select the original switching signal SWPB as the switching signal SWP4B. The routing circuit 212 may select the original switching signal SWN as the switching signal SWN4. The routing circuit 212 may select the original switching signal SWNB as the switching signal SWN4B.

Therefore, in case that the polarity inversion configuration signal DOTC is in the first logic state (for example, the logic state "0") (in a certain application situation), the routing circuit 212 may change the logic configuration of the switching control signals SC1-SCm to set the polarity configuration of the data lines D1-Dn to "+ − + − + − + − . . . " or "− + − + − + − + . . . " (determined by the original switching signals SWP and SWN). In case that the polarity inversion configuration signal DOTC is in the second logic state (for example, the logic state "1") (in another application situation), the routing circuit 212 may change the logic configuration of the switching control signals SC1-SCm to set the polarity configuration of the data lines D1-Dn to "+ − − + − ++ − . . . " or "− ++ − + − − + . . . " (determined by the original switching signals SWP and SWN).

Figure 6:
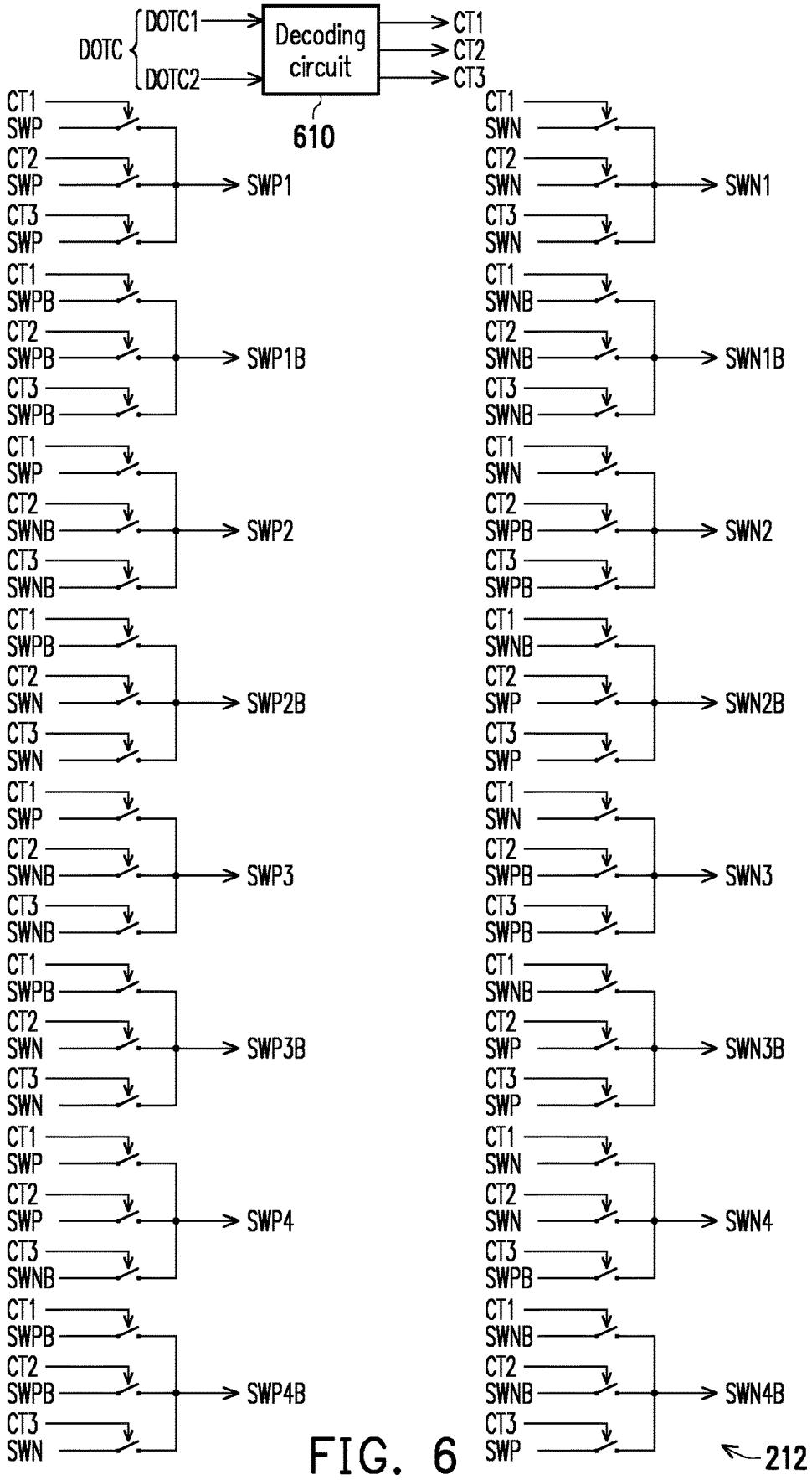
FIG. 6 is a circuit block schematic diagram of a routing circuit of FIG. 2 according to another embodiment of the invention.

FIG. 6 is a circuit block schematic diagram of the routing circuit 212 of FIG. 2 according to another embodiment of the invention. The routing circuit 212 shown in FIG. 6 includes a decoding circuit 610 and a plurality of switches, where the switches are controlled by a decoding result (control signals CT1, CT2, and CT3) of the decoding circuit 610. The decoding circuit 610 may decode the polarity inversion configuration signal DOTC to generate the decoding result. For example, in case that the relationship between the polarity inversion configuration signal DOTC and the decoding result is shown in Table 1 below.

TABLE 1 the relationship between the input and the output of the decoding circuit 610

| input | | output | | |
|---|---|---|---|---|
| DOTC2 | DOTC1 | CT1 | CT2 | CT3 |
| 0 | 0 | 1 | 0 | 0 |
| 0 | 1 | 0 | 1 | 0 |
| 1 | 0 or 1 | 0 | 0 | 1 |

In Table 1, a bit DOTC2 and a bit DOTC1 of the polarity inversion configuration signal DOTC are all in the logic state "0", the control signals CT1, CT2 and CT3 (the decoding result) are in logic states "1", "0" and "0". When the bit DOTC2 and the bit DOTC1 of the polarity inversion configuration signal DOTC are in logic states "0" and "1", the control signals CT1, CT2 and CT3 are in logic states "0", "1" and "0". When the bit DOTC2 and the bit DOTC1 of the polarity inversion configuration signal DOTC are in logic states "1" and "0" (or both "1"), the control signals CT1, CT2 and CT3 are in logic states "0", "0" and "1".

Referring to FIG. 2, FIG. 3, FIG. 4 and FIG. 6, the polarity control signal SC includes the original switching signals SWP, SWPB, SWN and SWNB. The switching control signal SC1 includes the switching signal SWP1, the switching signal SWP1B, the switching signal SWN1 and the switching signal SWN1B. The routing circuit 212 may select to output the original switching signal SWP as the switching signal SWP1 to the output switching circuit OSW_1. The routing circuit 212 may select to output the original switching signal SWPB as the switching signal SWP1B to the output switching circuit OSW_1. The routing circuit 212 may select to output the original switching signal SWN as the switching signal SWN1 to the output switching circuit OSW_1. The routing circuit 212 may select to output the original switching signal SWNB as the switching signal SWN1B to the output switching circuit OSW_1.

Deduced from the related description of the switching control signal SC1, the switching control signal SC2 may include the switching signal SWP2, the switching signal SWP2B, the switching signal SWN2 and the switching signal SWN2B. The routing circuit 212 may select to output one of the original switching signal SWP and the original switching signal SWNB as the switching signal SWP2 to the output switching circuit OSW_2 according to the decoding result (the control signals CT1, CT2 and CT3). The routing circuit 212 may select to output one of the original switching signal SWPB and the original switching signal SWN as the switching signal SWP2B to the output switching circuit OSW_2 according to the decoding result. The routing circuit 212 may select to output one of the original switching signal SWN and the original switching signal SWPB as the switching signal SWN2 to the output switching circuit OSW_2 according to the decoding result. The routing circuit 212 may select to output one of the original switching signal SWNB and the original switching signal SWP as the switching signal SWN2B to the output switching circuit OSW_2 according to the decoding result.

For example, when the decoding result is in a first logic state (for example, the controls signals CT1, CT2 and CT3 are in logic states "1", "0" and "0"), the routing circuit 212 may select the original switching signal SWP as the switching signal SWP2, the routing circuit 212 may select the original switching signal SWPB as the switching signal SWP2B, the routing circuit 212 may select the original switching signal SWN as the switching signal SWN2, and the routing circuit 212 may select the original switching signal SWNB as the switching signal SWN2B. When the decoding result is in a second logic state or a third logic state (for example, the controls signals CT1, CT2 and CT3 are in logic states "0", "1" and "0", or the controls signals CT1, CT2 and CT3 are in logic states "0", "0" and "1"), the routing circuit 212 may select the original switching signal SWNB as the switching signal SWP2, the routing circuit 212 may select the original switching signal SWN as the switching signal SWP2B, the routing circuit 212 may select the original switching signal SWPB as the switching signal SWN2, and the routing circuit 212 may select the original switching signal SWP as the switching signal SWN2B.

Deduced from related descriptions of the switching control signal SC1, the switching control signal SC3 (not shown) may include the switching signal SWP3, the switching signal SWP3B, the switching signal SWN3 and the switching signal SWN3B. When the decoding result is in the first logic state (for example, the control signals CT1, CT2 and CT3 are in logic states "1", "0" and "0"), the routing circuit 212 may select the original switching signal SWP as the switching signal SWP3, the routing circuit 212 may select the original switching signal SWPB as the switching signal SWP3B, the routing circuit 212 may select the original switching signal SWN as the switching signal SWN3, and the routing circuit 212 may select the original switching signal SWNB as the switching signal SWN3B. When the decoding result is in the second logic state or the third logic state (for example, the control signals CT1, CT2 and CT3 are in logic states "0", "1" and "0", or the control signals CT1, CT2 and CT3 are in logic states "0", "0" and "1"), the routing circuit 212 may select the original switching signal SWNB as the switching signal SWP3, the routing circuit 212 may select the original switching signal SWN as the switching signal SWP3B, the routing circuit 212 may select the original switching signal SWPB as the switching signal SWN3, and the routing circuit 212 may select the original switching signal SWP as the switching signal SWN3B.

Deduced from related descriptions of the switching control signal SC1, the switching control signal SC4 (not shown) may include the switching signal SWP4, the switching signal SWP4B, the switching signal SWN4 and the switching signal SWN4B. When the decoding result is in the first logic state or the second logic state (for example, the control signals CT1, CT2 and CT3 are in logic states "1", "0" and "0", or the control signals CT1, CT2 and CT3 are in logic states "0", "1" and "0"), the routing circuit 212 may select the original switching signal SWP as the switching signal SWP4, the routing circuit 212 may select the original switching signal SWPB as the switching signal SWP4B, the routing circuit 212 may select the original switching signal SWN as the switching signal SWN4, and the routing circuit 212 may select the original switching signal SWNB as the switching signal SWN4B. When the decoding result is in the third logic state (for example, the control signals CT1, CT2 and CT3 are in logic states "0", "0" and "1"), the routing circuit 212 may select the original switching signal SWNB as the switching signal SWP4, the routing circuit 212 may select the original switching signal SWN as the switching signal SWP4B, the routing circuit 212 may select the original switching signal SWPB as the switching signal SWN4, and the routing circuit 212 may select the original switching signal SWP as the switching signal SWN4B.

Therefore, in case that the relationship between the polarity inversion configuration signal DOTC and the polarity configuration of the data lines D1-Dn is shown in Table 2 below. In Table 2, the polarity inversion configuration signal DOTC is in a first logic state (for example, the logic state "00") (in a certain application situation), the routing circuit 212 may change the logic configuration of the switching control signals SC1-SCm to set the polarity configuration of the data lines D1-Dn to "+ − + − + − + − . . . " or "− + − + − + − + . . . " (determined by the original switching signals SWP and SWN). In case that the polarity inversion configuration signal DOTC is in a second logic state (for example, the logic state "01") (in another application situation), the routing circuit 212 may change the logic configuration of the switching control signals SC1-SCm to set the polarity configuration of the data lines D1-Dn to "+ − − + − ++ − . . . " or "− ++ − + − − + . . . " (determined by the original switching signals SWP and SWN). In case that the polarity inversion configuration signal DOTC is in a third logic state (for example, the logic state "10" or "11") (in still another application situation), the routing circuit 212 may change the logic configuration of the switching control signals SC1-SCm to set the polarity configuration of the data lines D1-Dn to "+ − − + − + − + . . . " or "− ++ − + − + − . . . " (determined by the original switching signals SWP and SWN).

TABLE 2 the relationship between the polarity inversion configuration signal DOTC and the the polarity configuration of the data lines D1-Dn

| DOTC | D1 | D2 | D3 | D4 | D5 | D6 | D7 | D8 |
|---|---|---|---|---|---|---|---|---|
| 00 | + | − | + | − | + | − | + | − |
| 01 | + | − | − | + | − | + | + | − |
| 10 or 11 | + | − | − | + | − | + | − | + |

Figure 7:
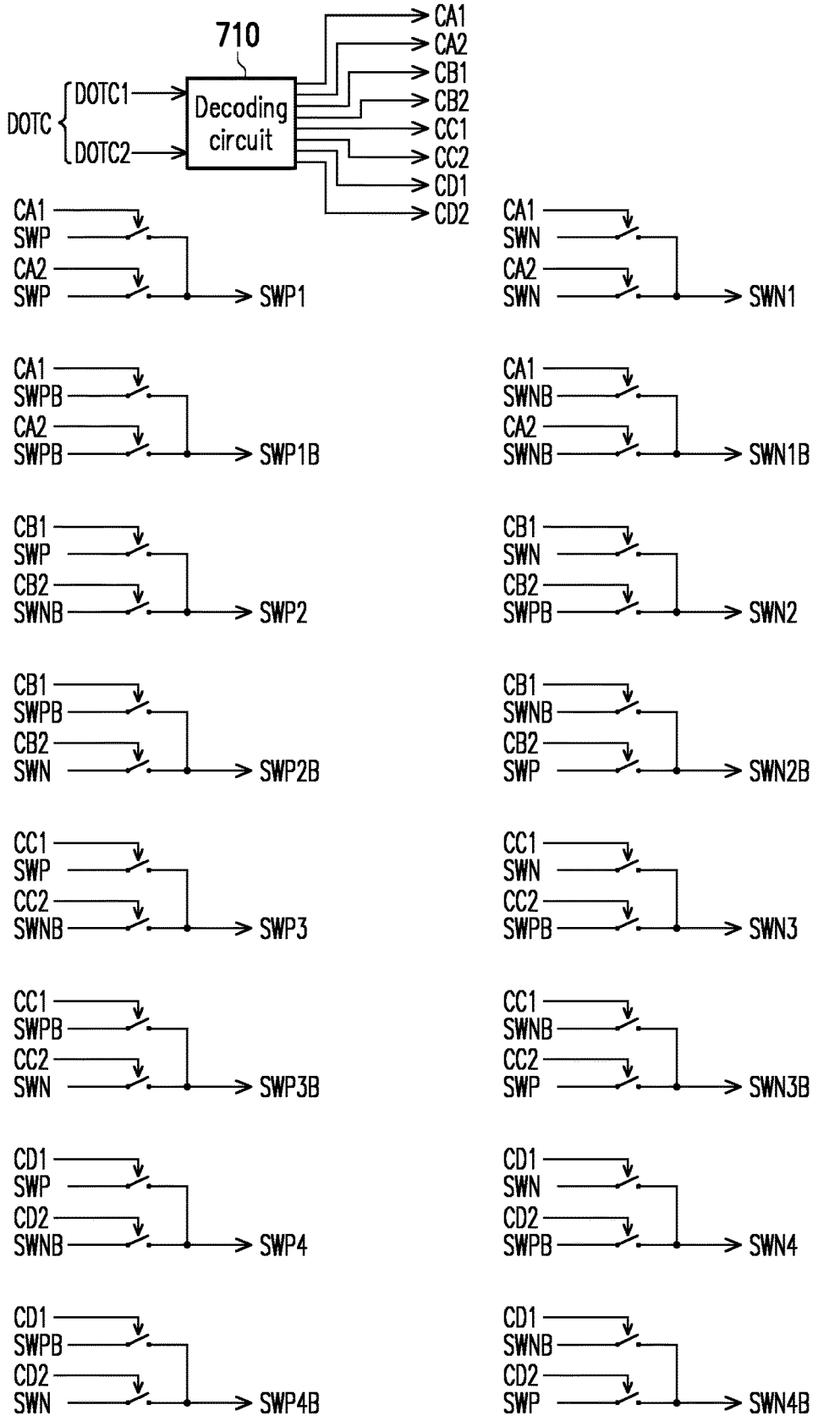
FIG. 7 is a circuit block schematic diagram of a routing circuit of FIG. 2 according to still another embodiment of the invention.

FIG. 7 is a circuit block schematic diagram of the routing circuit 212 of FIG. 2 according to still another embodiment of the invention. The routing circuit 212 shown in FIG. 7 includes a decoding circuit 710 and a plurality of switches, where the switches are controlled by a decoding result (control signals CA1, CA2, CB1, CB2, CC1, CC2, CD1 and CD2) of the decoding circuit 710. The decoding circuit 710 may decode the polarity inversion configuration signal DOTC to generate the decoding result. For example, in case that the relationship between the polarity inversion configuration signal DOTC and the decoding result is shown in Table 3 below.

TABLE 3 the relationship between the input and the output of the decoding circuit 710

| input | | output | | | | | | | |
|---|---|---|---|---|---|---|---|---|---|
| DOTC2 | DOTC1 | CA1 | CA2 | CB1 | CB2 | CC1 | CC2 | CD1 | CD2 |
| 0 | 0 | 1 | 0 | 1 | 0 | 1 | 0 | 1 | 0 |
| 0 | 1 | 1 | 0 | 0 | 1 | 0 | 1 | 1 | 0 |
| 1 | 0 or 1 | 1 | 0 | 0 | 1 | 0 | 1 | 0 | 1 |

In Table 3, a bit DOTC2 and a bit DOTC1 of the polarity inversion configuration signal DOTC are all in the logic state "0", the control signals CA1, CA2, CB1, CB2, CC1, CC2, CD1 and CD2 (the decoding result) are in logic states "1", "0", "1", "0", "1", "0", "1" and "0". When the bit DOTC2 and the bit DOTC1 of the polarity inversion configuration signal DOTC are in logic states "0" and "1", the control signals CA1, CA2, CB1, CB2, CC1, CC2, CD1 and CD2 are in logic states "1", "0", "0", "1", "0", "1", "1" and "0". When the bit DOTC2 and the bit DOTC1 of the polarity inversion configuration signal DOTC are in logic states "1" and "0" (or both "1"), the control signals CA1, CA2, CB1, CB2, CC1, CC2, CD1 and CD2 are in logic states "1" "0", "0", "1" "0", "1" "0" and "1".

Referring to FIG. 2, FIG. 3, FIG. 4 and FIG. 7, the polarity control signal SC includes the original switching signals SWP, SWPB, SWN and SWNB. The switching control signal SC1 includes the switching signal SWP1, the switching signal SWP1B, the switching signal SWN1 and the switching signal SWN1B. The routing circuit 212 may select to output the original switching signal SWP as the switching signal SWP1 to the output switching circuit OSW_1. The routing circuit 212 may select to output the original switching signal SWPB as the switching signal SWP1B to the output switching circuit OSW_1. The routing circuit 212 may select to output the original switching signal SWN as the switching signal SWN1 to the output switching circuit OSW_1. The routing circuit 212 may select to output the original switching signal SWNB as the switching signal SWN1B to the output switching circuit OSW_1.

Deduced from the related description of the switching control signal SC1, the switching control signal SC2 may include the switching signal SWP2, the switching signal SWP2B, the switching signal SWN2 and the switching signal SWN2B. The routing circuit 212 may select to output one of the original switching signal SWP and the original switching signal SWNB as the switching signal SWP2 to the output switching circuit OSW_2 according to the decoding result (the control signals CB1 and CB2). The routing circuit 212 may select to output one of the original switching signal SWPB and the original switching signal SWN as the switching signal SWP2B to the output switching circuit OSW_2 according to the decoding result (the control signals CB1 and CB2). The routing circuit 212 may select to output one of the original switching signal SWN and the original switching signal SWPB as the switching signal SWN2 to the output switching circuit OSW_2 according to the decoding result (the control signals CB1 and CB2). The routing circuit 212 may select to output one of the original switching signal SWNB and the original switching signal SWP as the switching signal SWN2B to the output switching circuit OSW_2 according to the decoding result (the control signals CB1 and CB2).

For example, when the decoding result is in a first logic state (for example, the controls signals CB1 and CB2 are in logic states "1" and "0"), the routing circuit 212 may select the original switching signal SWP as the switching signal SWP2, the routing circuit 212 may select the original switching signal SWPB as the switching signal SWP2B, the routing circuit 212 may select the original switching signal SWN as the switching signal SWN2, and the routing circuit 212 may select the original switching signal SWNB as the switching signal SWN2B. When the decoding result is in a second logic state or a third logic state (for example, the controls signals CB1 and CB2 are in logic states "0" and "1"), the routing circuit 212 may select the original switching signal SWNB as the switching signal SWP2, the routing circuit 212 may select the original switching signal SWN as the switching signal SWP2B, the routing circuit 212 may select the original switching signal SWPB as the switching signal SWN2, and the routing circuit 212 may select the original switching signal SWP as the switching signal SWN2B.

Deduced from related descriptions of the switching control signal SC1, the switching control signal SC3 (not shown) may include the switching signal SWP3, the switching signal SWP3B, the switching signal SWN3 and the switching signal SWN3B. When the decoding result is in the first logic state (for example, the control signals CC1 and CC2 are in logic states "1" and "0"), the routing circuit 212 may select the original switching signal SWP as the switching signal SWP3, the routing circuit 212 may select the original switching signal SWPB as the switching signal SWP3B, the routing circuit 212 may select the original switching signal SWN as the switching signal SWN3, and the routing circuit 212 may select the original switching signal SWNB as the switching signal SWN3B. When the decoding result is in the second logic state or the third logic state (for example, the control signals CC1 and CC2 are in logic states "0" and "1"), the routing circuit 212 may select the original switching signal SWNB as the switching signal SWP3, the routing circuit 212 may select the original switching signal SWN as the switching signal SWP3B, the routing circuit 212 may select the original switching signal SWPB as the switching signal SWN3, and the routing circuit 212 may select the original switching signal SWP as the switching signal SWN3B.

Deduced from related descriptions of the switching control signal SC1, the switching control signal SC4 (not shown) may include the switching signal SWP4, the switching signal SWP4B, the switching signal SWN4 and the switching signal SWN4B. When the decoding result is in the first logic state or the second logic state (for example, the control signals CD1 and CD2 are in logic states "1" and "0"), the routing circuit 212 may select the original switching signal SWP as the switching signal SWP4, the routing circuit 212 may select the original switching signal SWPB as the switching signal SWP4B, the routing circuit 212 may select the original switching signal SWN as the switching signal SWN4, and the routing circuit 212 may select the original switching signal SWNB as the switching signal SWN4B. When the decoding result is in the third logic state (for example, the control signals CD1 and CD2 are in logic states "0" and "1"), the routing circuit 212 may select the original switching signal SWNB as the switching signal SWP4, the routing circuit 212 may select the original switching signal SWN as the switching signal SWP4B, the routing circuit 212 may select the original switching signal SWPB as the switching signal SWN4, and the routing circuit 212 may select the original switching signal SWP as the switching signal SWN4B.

Therefore, in case that the polarity inversion configuration signal DOTC is in a first logic state (for example, the logic state "00") (in a certain application situation), the routing circuit 212 may change the logic configuration of the switching control signals SC1-SCm to set the polarity configuration of the data lines D1-Dn to "+ − + − + − + − . . . " or "− + − + − + − + . . . " (determined by the original switching signals SWP and SWN). In case that the polarity inversion configuration signal DOTC is in a second logic state (for example, the logic state "01") (in another application situation), the routing circuit 212 may change the logic configuration of the switching control signals SC1-SCm to set the polarity configuration of the data lines D1-Dn to "+ − − + − ++ − . . . " or "− ++ − + − − + . . . " (determined by the original switching signals SWP and SWN). In case that the polarity inversion configuration signal DOTC is in a third logic state (for example, the logic state "10" or "11") (in still another application situation), the routing circuit 212 may change the logic configuration of the switching control signals SC1-SCm to set the polarity configuration of the data lines D1-Dn to "+ − − + − + − + . . . " or "− ++ − + − + − . . . " (determined by the original switching signals SWP and SWN).

According to different design requirements, the blocks of the polarity inversion control circuit 210, the signal generating circuit 211, and (or) the routing circuit 212 may be implemented in form of hardware, firmware, software (i.e., program) or combinations thereof.

In terms of hardware, the blocks of the polarity inversion control circuit 210, the signal generating circuit 211, and (or) the routing circuit 212 may be implemented as logic circuits on an integrated circuit. Related functions of the polarity inversion control circuit 210, the signal generating circuit 211 and (or) the routing circuit 212 may be implemented as hardware by using hardware description languages (such as Verilog HDL or VHDL) or other suitable programming languages. For example, the related functions of the polarity inversion control circuit 210, the signal generating circuit 211 and (or) the routing circuit 212 may be implemented as various logic blocks, modules and circuits in one or a plurality of controllers, microcontrollers, microprocessors, application-specific integrated circuits (ASIC), digital signal processors (DSP), field programmable gate arrays (FPGA), and/or other processing units.

In terms of software and/or firmware, the related functions of the polarity inversion control circuit 210, the signal generating circuit 211, and (or) the routing circuit 212 can be implemented as programming codes. For example, the polarity inversion control circuit 210, the signal generating circuit 211 and (or) the routing circuit 212 are implemented by using general programming languages (such as C, C++ or a combination thereof) or other suitable programming languages. The programming codes may be recorded/stored in a recording medium, and the recording medium, for example, includes a read only memory (Read Only Memory, ROM), a storage device, and/or a random access memory (RAM). A computer, a central processing unit (CPU), a controller, a microcontroller, or a microprocessor may read the programming codes from the recording medium and execute the same to achieve the related functions. The recording medium may be a "non-transitory computer readable medium", for example, a tape, a disk, a card, a semiconductor memory, or a programmable logic circuit, etc. Moreover, the program may also be provided to the computer (or CPU) via any transmission medium (a communication network, a broadcast radio wave, etc.). The communication network is, for example, the Internet, wired communication, wireless communication, or other communication media.

In summary, the signal generating circuit 211 described in the above embodiments is configured to generate the polarity control signal SC (for example, the original switching signals SWP, SWPB, SWN, and SWNB). The routing circuit 212 is coupled to the signal generating circuit 211 to receive the polarity control signal SC. The routing circuit 212 is configured to output a plurality of the switching control signals SC1-SCm corresponding to the polarity control signal SC to a plurality of the output switching circuits OSW_1-OSW_m of a plurality of the channel pairs CHP_1-CHP_m of the source driver 200. The routing circuit 212 may change the correspondence between the polarity control signal SC and the switching control signals SC1-SCm according to the polarity inversion configuration signal DOTC. Therefore, the polarity inversion control circuit 210 may change the logic configuration of the switching control signals SC1-SCm according to different application situations, so as to set the polarity configuration of the data lines D1-Dn to meet the customer's requirements.

It will be apparent to those skilled in the art that various modifications and variations can be made to the disclosed embodiments without departing from the scope or spirit of the invention. In view of the foregoing, it is intended that the invention covers modifications and variations provided they fall within the scope of the following claims and their equivalents.

What is claimed is:

1. A source driver, comprising:

a plurality of channel pairs, adapted to drive a display panel, wherein each of the channel pairs comprises a positive polarity channel, a negative polarity channel, and an output switching circuit, a first input terminal and a second input terminal of the output switching circuit are respectively coupled to an output terminal of the positive polarity channel and an output terminal of the negative polarity channel, and a first output terminal and a second output terminal of the output switching circuit are coupled to the display panel; and a polarity inversion control circuit, comprising:

a signal generating circuit, configured to generate a polarity control signal; and a routing circuit, coupled to the signal generating circuit to receive the polarity control signal, and configured to output a plurality of switching control signals corresponding to the polarity control signal to the output switching circuits, wherein the routing circuit changes a logic configuration of the switching control signals to change a correspondence between the polarity control signal and the switching control signals according to a polarity inversion configuration signal, wherein the polarity control signal comprises a first original switching signal and a second original switching signal, the second original switching signal is an inverted signal of the first original switching signal, and the signal generating circuit comprises:

a logic circuit, configured to generate a first logic signal according to a line latch signal and a polarity signal; and a first level shifter, coupled to the logic circuit to receive the first logic signal, and configured to generate the first original switching signal and the second original switching signal.

2. The source driver as claimed in claim 1, wherein the logic circuit further generates a second logic signal according to the line latch signal and the polarity signal, the polarity control signal further comprises a third original switching signal and a fourth original switching signal, the fourth original switching signal is an inverted signal of the third original switching signal, and the signal generating circuit further comprises:

a second level shifter, coupled to the logic circuit to receive the second logic signal, and configured to generate the third original switching signal and the fourth original switching signal.

3. The source driver as claimed in claim 1, wherein any one of the switching control signals comprises a first switching signal, a second switching signal, a third switching signal and a fourth switching signal, the second switching signal is an inverted signal of the first switching signal, the fourth switching signal is an inverted signal of the third switching signal, and the output switching circuit of any one of the channel pairs comprises:

a first buffer, having an input terminal coupled to the routing circuit to receive the first switching signal;

a second buffer, having an input terminal coupled to the routing circuit to receive the second switching signal;

a third buffer, having an input terminal coupled to the routing circuit to receive the third switching signal;

a fourth buffer, having an input terminal coupled to the routing circuit to receive the fourth switching signal;

a first switch, having a control terminal coupled to an output terminal of the first buffer, wherein a first terminal of the first switch is coupled to the first input terminal of the output switching circuit, and a second terminal of the first switch is coupled to the first output terminal of the output switching circuit;

a second switch, having a control terminal coupled to an output terminal of the second buffer, wherein a first terminal of the second switch is coupled to the second input terminal of the output switching circuit, and a second terminal of the second switch is coupled to the second output terminal of the output switching circuit;

a third switch, having a control terminal coupled to an output terminal of the third buffer, wherein a first terminal of the third switch is coupled to the second input terminal of the output switching circuit, and a second terminal of the third switch is coupled to the first output terminal of the output switching circuit; and a fourth switch, having a control terminal coupled to an output terminal of the fourth buffer, wherein a first terminal of the fourth switch is coupled to the first input terminal of the output switching circuit, and a second terminal of the fourth switch is coupled to the second output terminal of the output switching circuit.

4. The source driver as claimed in claim 1, wherein the polarity control signal comprises the first original switching signal, the second original switching signal, a third original switching signal and a fourth original switching signal; a first switching control signal in the switching control signals comprises a first switching signal, a second switching signal, a third switching signal and a fourth switching signal; the routing circuit selects the first original switching signal as the first switching signal; the routing circuit selects the second original switching signal as the second switching signal; the routing circuit selects the third original switching signal as the third switching signal; and the routing circuit selects the fourth original switching signal as the fourth switching signal.

5. The source driver as claimed in claim 4, wherein a second switching control signal in the switching control signals comprises a fifth switching signal, a sixth switching signal, a seventh switching signal and an eighth switching signal; the routing circuit selects one of the first original switching signal and the fourth original switching signal as the fifth switching signal according to the polarity inversion configuration signal; the routing circuit selects one of the second original switching signal and the third original switching signal as the sixth switching signal according to the polarity inversion configuration signal; the routing circuit selects one of the third original switching signal and the second original switching signal as the seventh switching signal according to the polarity inversion configuration signal; and the routing circuit selects one of the fourth original switching signal and the first original switching signal as the eighth switching signal according to the polarity inversion configuration signal.

6. The source driver as claimed in claim 5, wherein when the polarity inversion configuration signal is in a first logic state, the routing circuit selects the first original switching signal as the fifth switching signal, the routing circuit selects the second original switching signal as the sixth switching signal, the routing circuit selects the third original switching signal as the seventh switching signal, and the routing circuit selects the fourth original switching signal as the eighth switching signal; and when the polarity inversion configuration signal is in a second logic state, the routing circuit selects the fourth original switching signal as the fifth switching signal, the routing circuit selects the third original switching signal as the sixth switching signal, the routing circuit selects the second original switching signal as the seventh switching signal, and the routing circuit selects the first original switching signal as the eighth switching signal.

7. The source driver as claimed in claim 4, wherein the routing circuit comprises:

a decoding circuit, configured to decode the polarity inversion configuration signal to generate a decoding result;

wherein a second switching control signal in the switching control signals comprises a fifth switching signal, a sixth switching signal, a seventh switching signal and an eighth switching signal, the routing circuit selects one of the first original switching signal and the fourth original switching signal as the fifth switching signal according to the decoding result, the routing circuit selects one of the second original switching signal and the third original switching signal as the sixth switching signal according to the decoding result, the outing circuit selects one of the third original switching signal and the second original switching signal as the seventh switching signal according to the decoding result, and the routing circuit selects one of the fourth original switching signal and the first original switching signal as the eighth switching signal according to the decoding result.

8. The source driver as claimed in claim 7, wherein when the decoding result is in a first logic state, the routing circuit selects the first original switching signal as the fifth switching signal, the routing circuit selects the second original switching signal as the sixth switching signal, the routing circuit selects the third original switching signal as the seventh switching signal, and the routing circuit selects the fourth original switching signal as the eighth switching signal; and when the decoding result is in a second logic state or a third logic state, the routing circuit selects the fourth original switching signal as the fifth switching signal, the routing circuit selects the third original switching signal as the sixth switching signal, the routing circuit selects the second original switching signal as the seventh switching signal, and the routing circuit selects the first original switching signal as the eighth switching signal.

9. The source driver as claimed in claim 7, wherein when the decoding result is in a first logic state or a second logic state, the routing circuit selects the first original switching signal as the fifth switching signal, the routing circuit selects the second original switching signal as the sixth switching signal, the routing circuit selects the third original switching signal as the seventh switching signal, and the routing circuit selects the fourth original switching signal as the eighth switching signal; and when the decoding result is in a third logic state, the routing circuit selects the fourth original switching signal as the fifth switching signal, the routing circuit selects the third original switching signal as the sixth switching signal, the routing circuit selects the second original switching signal as the seventh switching signal, and the routing circuit selects the first original switching signal as the eighth switching signal.

10. A polarity inversion control circuit, comprising:

a signal generating circuit, configured to generate a polarity control signal; and a routing circuit, coupled to the signal generating circuit to receive the polarity control signal, and configured to output a plurality of switching control signals corresponding to the polarity control signal to a plurality of output switching circuits of a plurality of channel pairs of a source driver, wherein the routing circuit changes a logic configuration of the switching control signals to change a correspondence between the polarity control signal and the switching control signals according to a polarity inversion configuration signal, wherein the polarity control signal comprises a first original switching signal and a second original switching signal, the second original switching signal is an inverted signal of the first original switching signal, and the signal generating circuit comprises:

a logic circuit, configured to generate a first logic signal according to a line latch signal and a polarity signal; and a first level shifter, coupled to the logic circuit to receive the first logic signal, and configured to generate the first original switching signal and the second original switching signal.

11. The polarity inversion control circuit as claimed in claim 10, wherein the logic circuit further generates a second logic signal according to the line latch signal and the polarity signal, the polarity control signal further comprises a third original switching signal and a fourth original switching signal, the fourth original switching signal is an inverted signal of the third original switching signal, and the signal generating circuit further comprises:

a second level shifter, coupled to the logic circuit to receive the second logic signal, and configured to generate the third original switching signal and the fourth original switching signal.

12. The polarity inversion control circuit as claimed in claim 10, wherein the polarity control signal comprises the first original switching signal, the second original switching signal, a third original switching signal and a fourth original switching signal; a first switching control signal in the switching control signals comprises a first switching signal, a second switching signal, a third switching signal and a fourth switching signal; the routing circuit selects the first original switching signal as the first switching signal; the routing circuit selects the second original switching signal as the second switching signal; the routing circuit selects the third original switching signal as the third switching signal; and the routing circuit selects the fourth original switching signal as the fourth switching signal.

13. The polarity inversion control circuit as claimed in claim 12, wherein a second switching control signal in the switching control signals comprises a fifth switching signal, a sixth switching signal, a seventh switching signal and an eighth switching signal; the routing circuit selects one of the first original switching signal and the fourth original switching signal as the fifth switching signal according to the polarity inversion configuration signal; the routing circuit selects one of the second original switching signal and the third original switching signal as the sixth switching signal according to the polarity inversion configuration signal; the routing circuit selects one of the third original switching signal and the second original switching signal as the seventh switching signal according to the polarity inversion configuration signal; and the routing circuit selects one of the fourth original switching signal and the first original switching signal as the eighth switching signal according to the polarity inversion configuration signal.

14. The polarity inversion control circuit as claimed in claim 13, wherein when the polarity inversion configuration signal is in a first logic state, the routing circuit selects the first original switching signal as the fifth switching signal, the routing circuit selects the second original switching signal as the sixth switching signal, the routing circuit selects the third original switching signal as the seventh switching signal, and the routing circuit selects the fourth original switching signal as the eighth switching signal; and when the polarity inversion configuration signal is in a second logic state, the routing circuit selects the fourth original switching signal as the fifth switching signal, the routing circuit selects the third original switching signal as the sixth switching signal, the routing circuit selects the second original switching signal as the seventh switching signal, and the routing circuit selects the first original switching signal as the eighth switching signal.

15. The polarity inversion control circuit as claimed in claim 12, wherein the routing circuit comprises:

a decoding circuit, configured to decode the polarity inversion configuration signal to generate a decoding result;

wherein a second switching control signal in the switching control signals comprises a fifth switching signal, a sixth switching signal, a seventh switching signal and an eighth switching signal, the routing circuit selects one of the first original switching signal and the fourth original switching signal as the fifth switching signal according to the decoding result, the routing circuit selects one of the second original switching signal and the third original switching signal as the sixth switching signal according to the decoding result, the routing circuit selects one of the third original switching signal and the second original switching signal as the seventh switching signal according to the decoding result, and the routing circuit selects one of the fourth original switching signal and the first original switching signal as the eighth switching signal according to the decoding result.

16. The polarity inversion control circuit as claimed in claim 15, wherein when the decoding result is in a first logic state, the routing circuit selects the first original switching signal as the fifth switching signal, the routing circuit selects the second original switching signal as the sixth switching signal, the routing circuit selects the third original switching signal as the seventh switching signal, and the routing circuit selects the fourth original switching signal as the eighth switching signal; and when the decoding result is in a second logic state or a third logic state, the routing circuit selects the fourth original switching signal as the fifth switching signal, the routing circuit selects the third original switching signal as the sixth switching signal, the routing circuit selects the second original switching signal as the seventh switching signal, and the routing circuit selects the first original switching signal as the eighth switching signal.

17. The polarity inversion control circuit as claimed in claim 15, wherein when the decoding result is in a first logic state or a second logic state, the routing circuit selects the first original switching signal as the fifth switching signal, the routing circuit selects the second original switching signal as the sixth switching signal, the routing circuit selects the third original switching signal as the seventh switching signal, and the routing circuit selects the fourth original switching signal as the eighth switching signal; and when the decoding result is in a third logic state, the routing circuit selects the fourth original switching signal as the fifth switching signal, the routing circuit selects the third original switching signal as the sixth switching signal, the routing circuit selects the second original switching signal as the seventh switching signal, and the routing circuit selects the first original switching signal as the eighth switching signal.

* * * * *